United States Patent [19]

Calvert

[11] 4,098,055

[45] Jul. 4, 1978

[54] APPARATUS FOR LOADING GROUPS OF ARTICLES INTO TRAYS

[75] Inventor: Rodney K. Calvert, Dunwoody, Ga.

[73] Assignee: The Mead Corporation, Dayton, Ohio

[21] Appl. No.: 788,210

[22] Filed: Apr. 18, 1977

Related U.S. Application Data

[62] Division of Ser. No. 730,747, Oct. 8, 1976.

[51] Int. Cl.[2] ..... B65B 5/08; B65B 5/10

[52] U.S. Cl. ..... 53/160; 53/166; 53/247; 53/251

[58] Field of Search .....53/26, 35, 160, 164, 53/166, 247, 251; 214/1 BC

[56] References Cited

U.S. PATENT DOCUMENTS

| | | | |
|---|---|---|---|
| 2,197,389 | 4/1940 | Vannucci | 294/87.24 |
| 2,277,688 | 3/1942 | Cattonar et al. | 53/160 |
| 2,807,125 | 9/1957 | George | 53/247 X |
| 2,938,315 | 5/1960 | Voullaire | 53/35 |
| 3,780,492 | 12/1973 | Corderoy | 53/247 |

FOREIGN PATENT DOCUMENTS

| | | | |
|---|---|---|---|
| 1,080,408 | 8/1967 | United Kingdom | 53/247 |

*Primary Examiner*—Robert Louis Spruill
*Attorney, Agent, or Firm*—Walter M. Rodgers; Walter A. Rodgers

[57] ABSTRACT

A method and apparatus for setting up and loading a tray includes means for withdrawing collapsed trays from a hopper and for forming those trays into a tubular structure and for subsequently manipulating end closure panels so as to close the ends of the tray, means for depositing the tray at a loading station together with article handling mechanisms for removing articles from a receiving station and then for transporting the articles to the loading station where the articles are released into the apertured top panel of the tray.

14 Claims, 14 Drawing Figures

APPARATUS FOR LOADING GROUPS OF ARTICLES INTO TRAYS

This is a division of application Ser. No. 730,747 filed Oct. 8, 1976.

Trays of the type in which a plurality of article receiving apertures are formed in the top panel of a tray have customarily been loaded by hand. Such loading operations have inhibited the use of such trays for article shipping, storage and dispensing purposes. According to this invention automatic apparatus is provided for quickly and efficiently manipulating articles from a receiving station into the apertures formed in the top wall of a tray located at a loading station. The articles are supplied to a receiving station by conveyor means which operates in synchronism and intermittently alongside the path of movement of a tray which is withdrawn from a hopper, set-up and moved alongside the article conveyor to a loading station at which articles removed from the conveyor means at the receiving station are elevated and moved above and downwardly into cooperative relation with the apertures formed in the top wall of the tray at the loading station.

An article handling mechanism constructed according to one form of this invention utilizes a plurality of horizontally spaced article engaging elements disposed about an article, each of said elements being angularly movable about a substantially vertical axis and each element having an article engaging surface and an aritcle clearing surface disposed about its periphery. Operating means interconnected with each of the article engaging elements imparts limited angular movement thereto to cause the article clearing surfaces to move from an initial position adjacent to and in clearing relation with respect to the article and to cause the article engaging surface to engage the article. Thereafter transport means is employed for moving the elements and the article simultaneously.

Apparatus for setting up collapsed trays having top, bottom and side walls interconnected along their side edges to form tubular structures and having end closure panels foldably joined to the ends of the bottom walls and including locking tabs engageable with apertures in the top walls includes a hopper in which collapsed trays are disposed, means for sequentially withdrawing the trays from the hopper, abutment means engageable with an edge of each tray during withdrawal from the hopper for initiating a setting up operation, panel separating means insertable through aperture means in the tray bottom wall for engaging the inner surface of one side wall to break any possible glue bond tending to hold the top and bottom walls together and to insure separating movement thereof, and probe means disposed in the path of movement of the tray during its withdrawal from the hopper and insertable through aperture means formed in the tray bottom wall for engaging the tray top wall to bow the top wall upwardly together with panel closing means for engaging the tray end closure panels and for causing the locking tabs thereon to enter corresponding apertures in the tray top wall while at least a part of the top wall is elevated by said probe means.

For a better understanding of the invention, reference may be had to the following detailed description taken in conjunction with the accompanying drawings in which FIG. 1 is a perspective view of a set-up of the type utilized in practicing the invention;

FIG. 12 is a plan view taken substantially along the line designated 12—12 in FIG. 4 and in which

Figure 1:
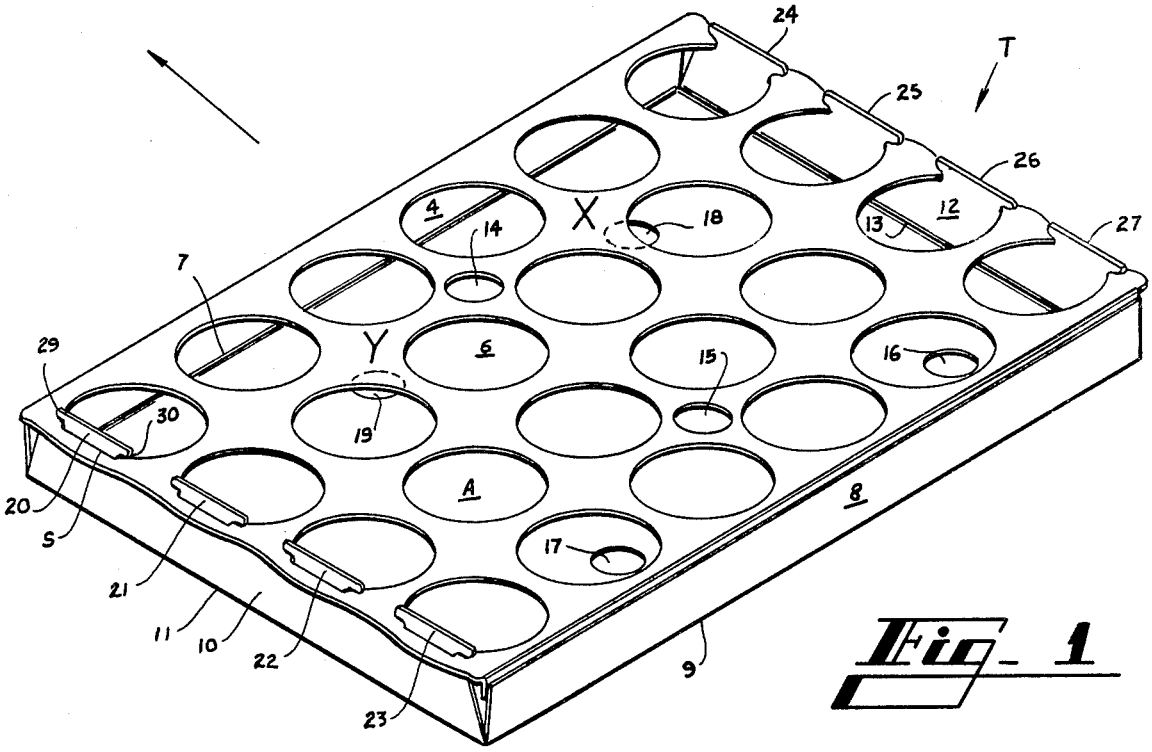
FIG. 1A is a plan view of a blank from which the tray of FIG. 1 is formed.

A tray of the type employed in conjunction with the present invention is fully disclosed and claimed in U.S. Pat. No. 4,053,099 issued Oct 11, 1977 and assigned to the assignee of this invention. For the sake of completeness, a brief description of the tray is set forth below.

In the drawings the numeral 1 designates the top wall of an article tray to the side edge 2 of which glue flap 3 is foldably joined. On the other side of top wall 1, a side wall 4 is foldably joined thereto along fold line 5 while bottom wall 6 is foldably joined to the side wall 4 along fold line 7. In addition side wall 8 is foldably joined to bottom wall 6 along fold line 9. End panel 10 is foldably joined to bottom wall 6 along fold line 11 while in similar fashion end panel 12 is foldably joined to bottom wall 6 along fold line 13.

For the purpose of receiving the articles, a plurality of apertures A are formed in top wall 1. Each aperture A which is disposed adjacent an end of the carrier is provided with a locking surface S. Also formed in top wall 1 are a pair of finger receiving apertures 14 and 15. To facilitate machine manipulation of the package, a plurality of machine element receiving apertures 16, 17, 18 and 19 are provided and are formed in bottom wall 6.

A plurality of locking tabs 20, 21, 22 and 23 are formed along the top edge of end panel 10. In like manner locking tabs 24, 25, 26 and 27 are formed on end panel 12. The locking tabs are similarly constructed and in order to simplify the description of the various components, only one locking tab will be described in detail, it being understood that the same structure is embodied in each locking tab. Referring specifically to locking tab 24, a pair of spaced shoulders are designated by numerals 29 and 30. Disposed adjacent shoulders 29 and 30 respectively and formed on the upper edge of end panel 12 are a pair of notches 31 and 32.

Disposed generally intermediate two associated locking tabs and formed on the upper edge of end panel 10 are stabilizing tabs 33, 34 and 35. In like manner, a plurality of stabilizing tabs 36, 37 and 38 are formed on end panel 12.

Figure 1A:
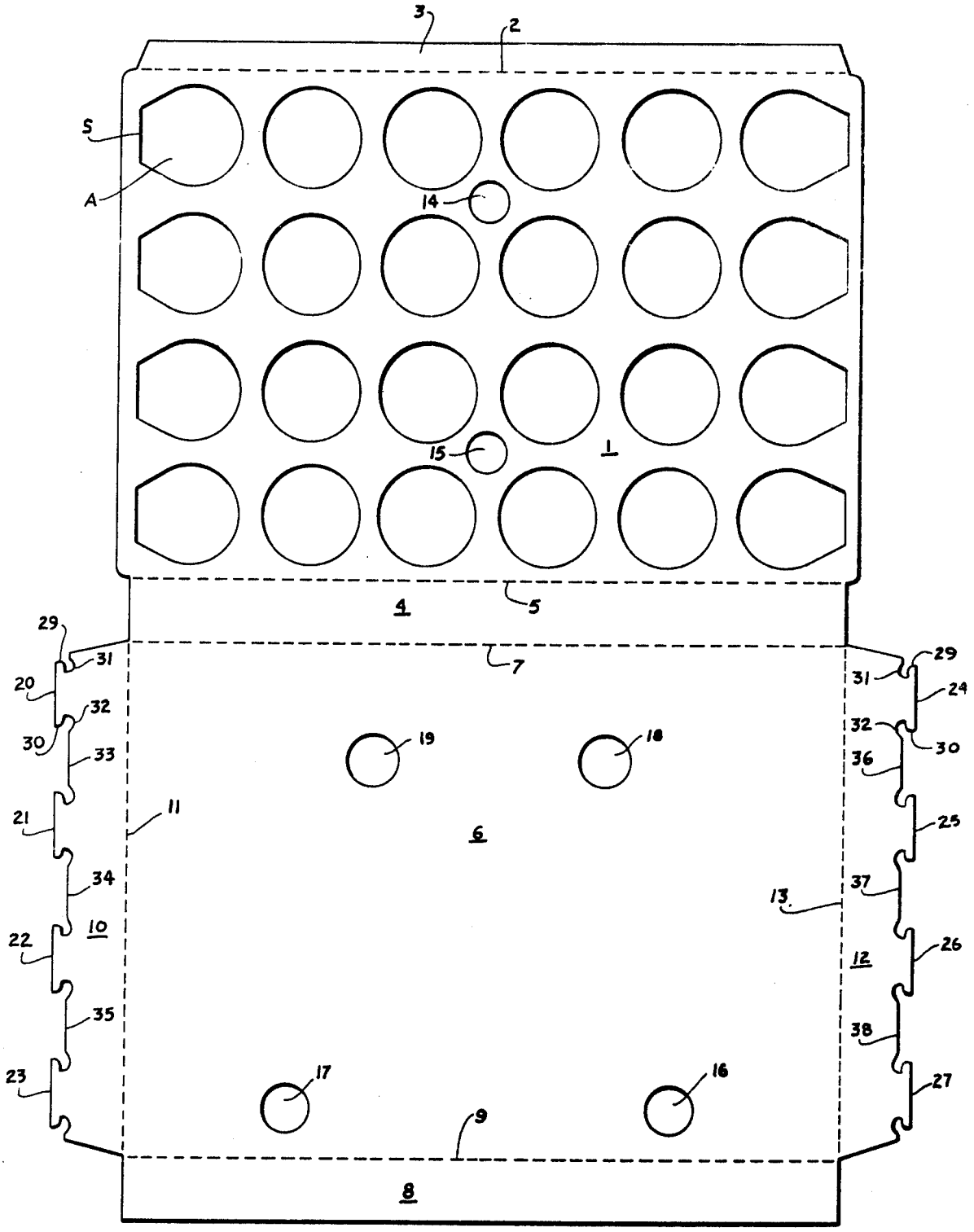

In order to manipulate the blank shown in FIG. 1A into the completed and set-up tray as shown in FIG. 1, it is simply necessary to fold top wall 1 together with glue flap 3 upwardly and forwardly along fold line 5 into flat face contacting relation with bottom wall 6 and side wall 4. Thereafter an appropriate application of glue is made to glue flap 3. Side wall 8 is then folded upwardly along fold line 9 and an edge thereof becomes adhered to glue flap 3. The tray is then disposed in collapsed condition.

In order to set up the tray, top wall 1 and bottom wall 6 are simply pulled apart and manipulated to a point where they are perpendicular to side walls 4 and 8. Thereafter each of the end panels 10 and 12 is folded upwardly along the respective fold lines 11 and 13 through an angle greater than 90° and simultaneously locking tabs 20–27 are extended through their associated apertures A. The end panels 10 and 12 are then swung generally outwardly toward the respective ends of the tray whereby locking tabs 20–27 assume as abutting relationship with the associated locking surfaces S of apertures A. The tray then appears as shown in FIG. 1.

Figure 2:
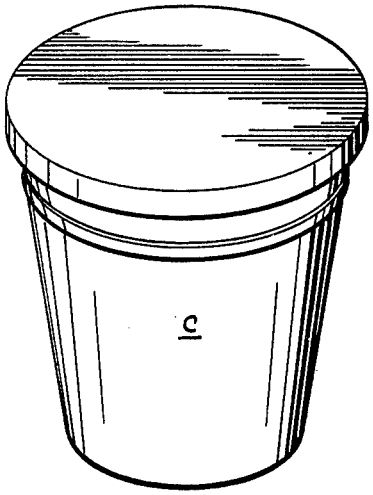
FIG. 2 is a perspective view of a container which ordinarily is filled with a consumer type product and which is manipulated into apertures formed in the top wall of the tray according to the method and apparatus of this invention.
Figure 4:
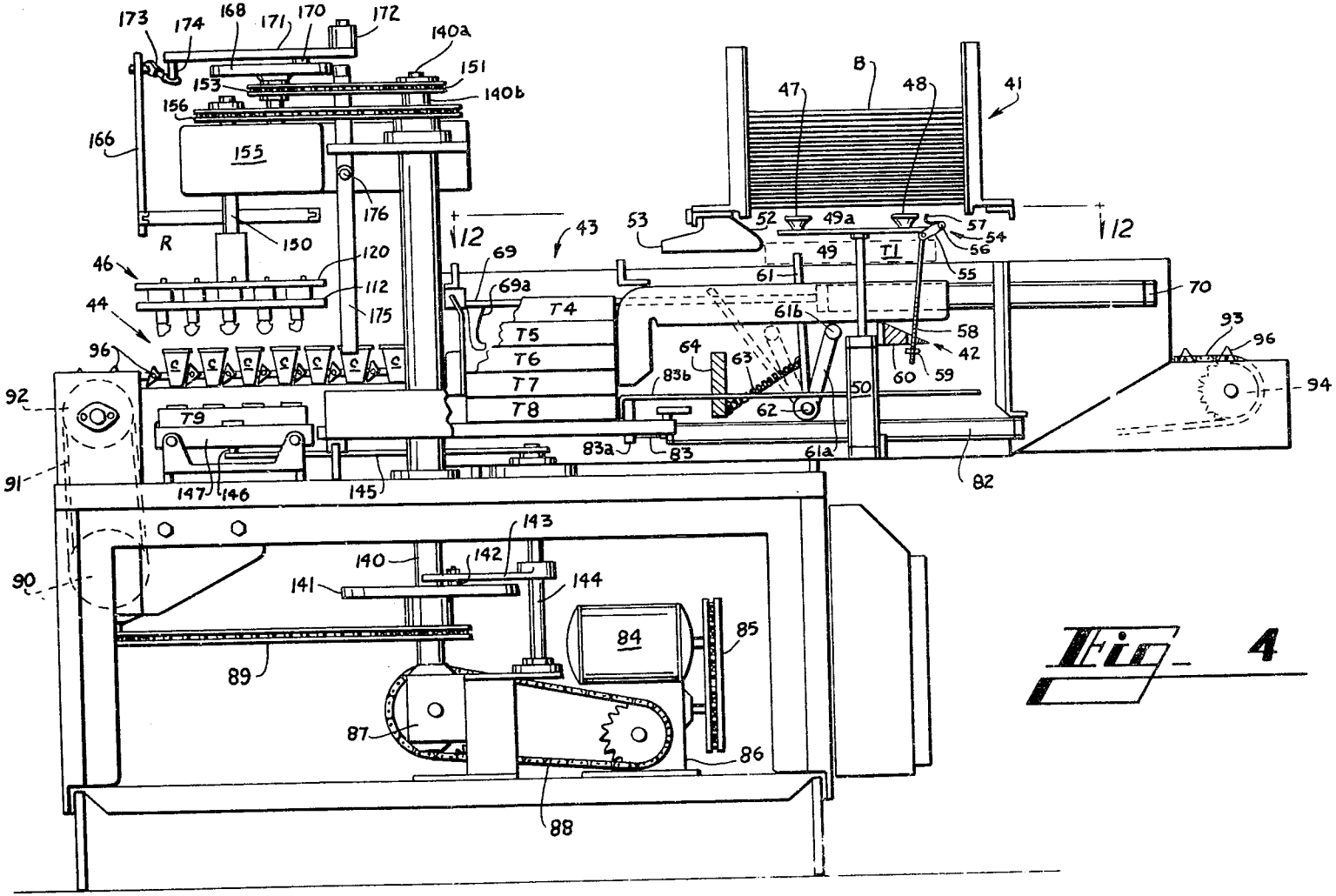
FIG. 4 is a side view of apparatus embodying the invention.
Figure 5:
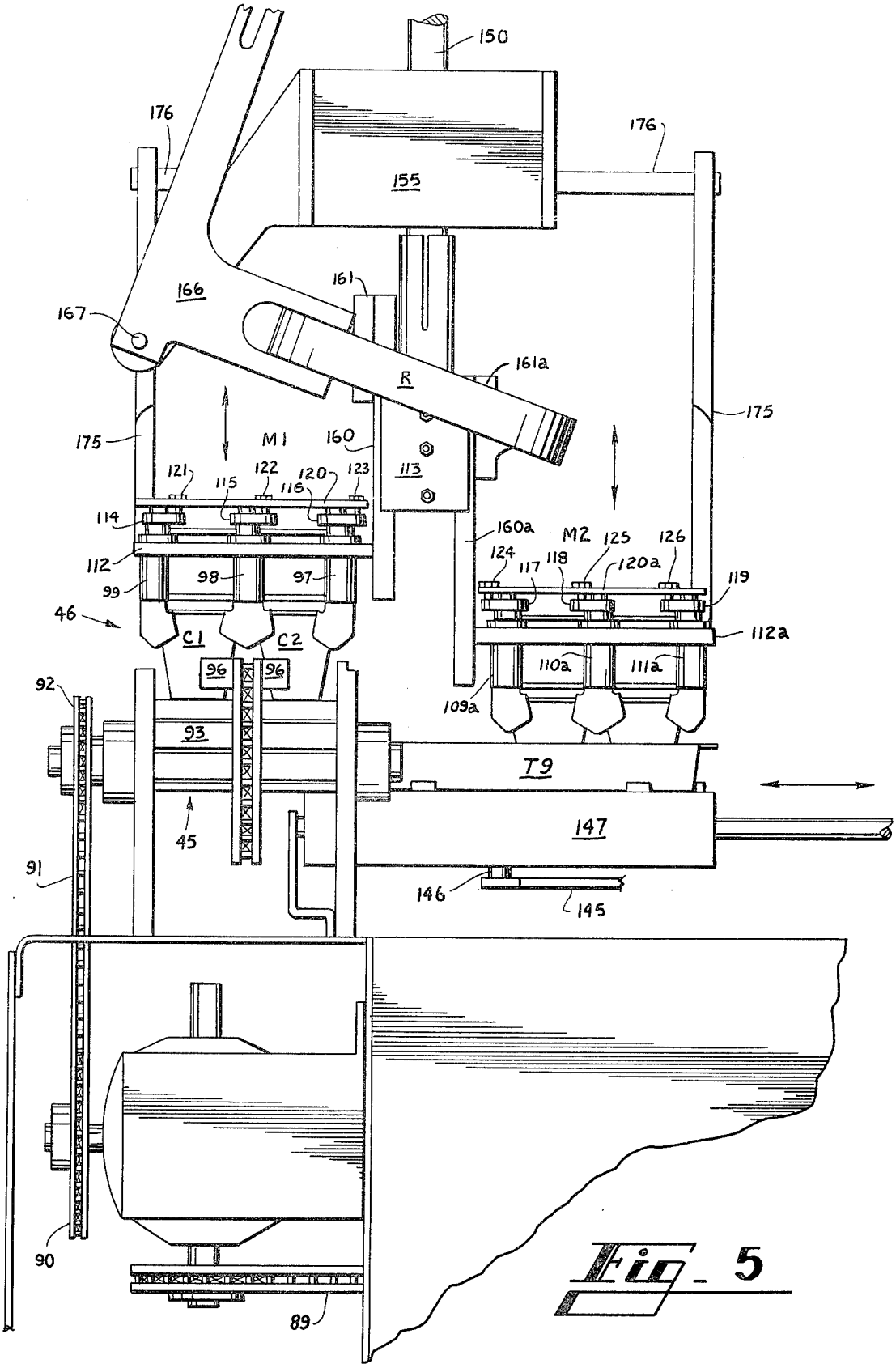
FIG. 5 is an end view of the left hand end of the apparatus shown in FIG. 4 and which shows the two article handling mechanisms disposed in their lowermost positions.

As is best shown in the overall side and end views designated as FIGS. 4 and 5, a plurality of blanks B are disposed in a hopper generally designated by the numeral 41. The lowermost blank B is withdrawn downwardly and set up into completed position by the tray forming apparatus generally designated by the numeral 42. Motive means drives the set-up tray into a deposit station generally designated at 43 from whence the lowermost tray such as that designated at T8 is moved toward the left into a loading station generally designated by the numeral 44. Containers such as are designated at C and as shown in FIG. 2 are supplied on conveyor means generally designated by the numeral 45 to a receiving station generally designated by the numeral 46. Containers C at receiving station 46 are picked up and transported by article handling mechanisms M1 and M2 constructed according to this invention to the loading station designated by the numeral 44 where the articles are deposited into a tray T9 at that station. After a loading operation is completed the loaded tray is moved out of the loading station 44 toward the left by a succeeding unloaded tray pushed from the bottom of the stack of trays at deposit station 43.

As viewed in FIG. 4 the blanks B are oriented with their glue flap 3 and side wall 8 along their right hand or trailing edge. The lowermost blank B is withdrawn from hopper 41 by mechanism including suction cups 47 and 48 which are mounted on reciprocable piston rod 49 driven by piston means disposed within cylinder 50. Downward movement of the lowermost blank from the hopper 41 causes the leading or left hand edge of the blank to engage the abutment surface 52 of abutment means 53 and by this means the setting up operation of the blank is initiated. This aspect of the apparatus is more fully disclosed in U.S. patent application Ser. No. 568,243 filed Apr. 15, 1975 now U.S. Pat. No. 3,991,660, and assigned to the assignee of this invention.

Since the glue flap 3 and side wall 8 are located at the right hand edge of the blanks B as viewed in FIG. 4, there may be a tendency for glue to inhibit setting up of the blank. In order to insure that the blank will set up properly, panel separating means 54 is employed. Panel separating means 54 includes an arm 55 pivoted at pin 56 to plate **49*a* on which suction cups 47 and 48 are mounted. Panel separating means 54 also includes finger like structures 57 which are two in number and which swing through the apertures 16 and 17 formed in the bottom wall 6 of the tray. A torsion spring (not shown) disposed about pivot pin 56 biases fingers 57 clockwise. These fingers engage the side wall 8 to which the glue flap 3 is secured and insure that the carton will set up propeerly into tubular condition. Operation in a clockwise direction of the fingers 57 as viewed in FIG. 4 is effected by the torsion spring about shaft 56. A nut 59 threaded to rod 58 at its lower end together with fixed element 60 having an aperture through which rod 58 extends functions to rotate fingers 57 counterclockwise as the plate 49a reaches its upper limit of travel. This action allows vacuum cups 47 and 48 to engage the lowermost tray. Thereafter downward movement of the tray and suction cups frees the fingers 57 to return in clockwise direction about shaft 56**.

Figure 12:
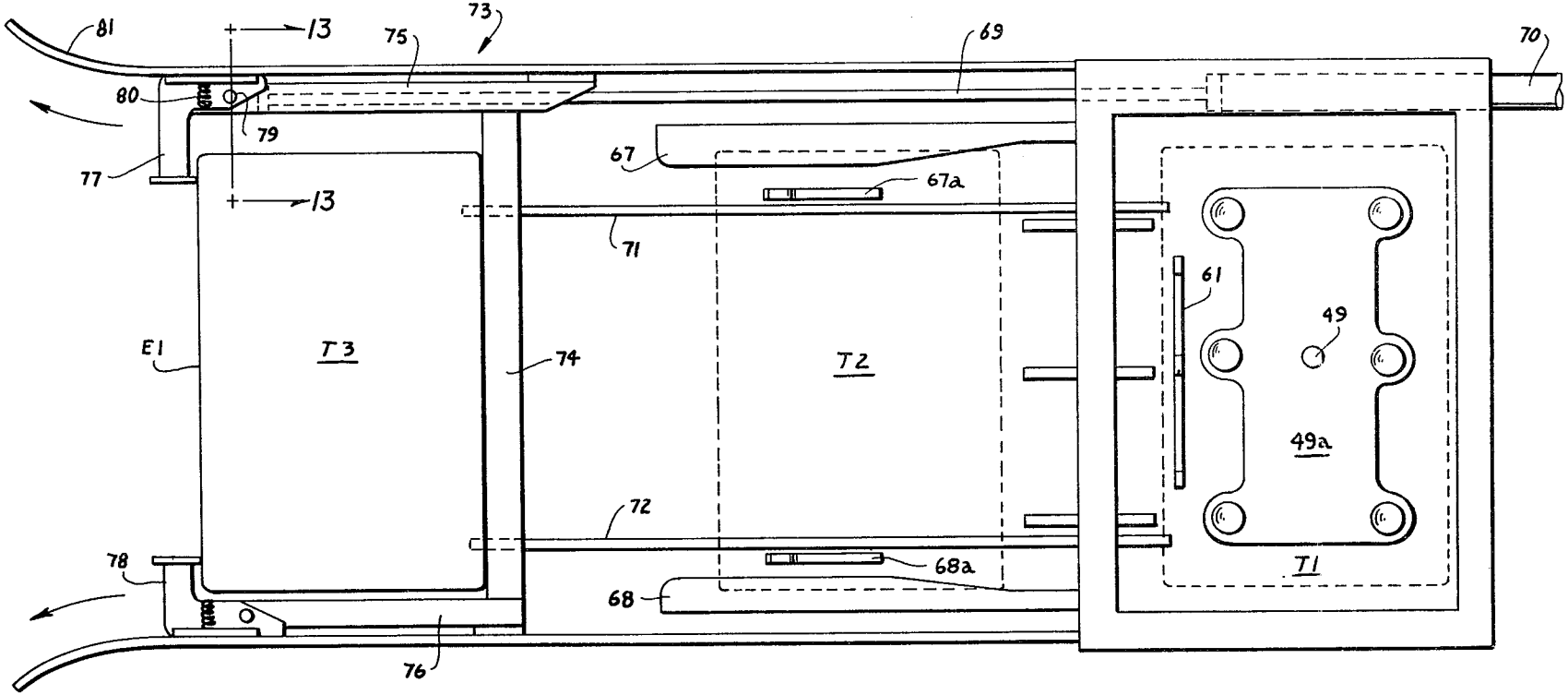
Figure 13:
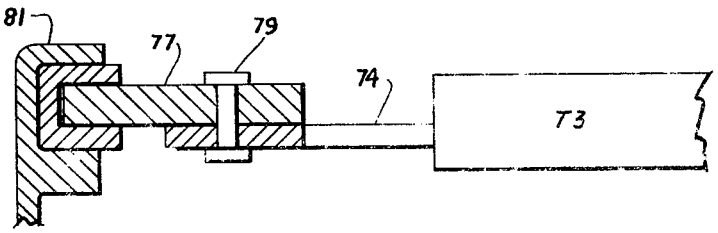
FIG. 13 is an enlarged cross-sectional view taken along the line designated 13—13 in FIG. 12.

In order to facilitate closing the end panels 10 and 12, it is necessary to cause the top panel 1 to bow upwardly and by this means to allow the locking tabs 20–27 disposed along the top edges of the end closure panels such as 10 and 12 to enter the corresponding apertures as described. For this purpose a probe 61 is pivoted about pivot pin 62 and biased by tension spring 63 toward counterclockwise rotation about pivot 62. Spring 63 is anchored on support structure 64. Thus as the lowermost blank B is drawn downwardly, the two forks of probe 61 enter apertures 18 and 19 formed in bottom wall 6 of the tray. These probes then engage the top wall at approximately the areas indicated at X and Y in FIG. 1 and thus impart an upward bowing action to the top wall as is indicated schematically in FIG. 4. With the top wall bowed upwardly as indicated in FIG. 4, the tray is moved toward the left and the end panels 10 and 12 are engaged by static plows 67 and 68 as best shown in FIG. 12. Static plows **67*a* and 68*a* shown in FIG. 12 engage top wall 1 and urge that wall downwardly to complete the locking action. This movement plows the end panels inwardly and allows the locks to enter their appropriate apertures and the tray is then complete and simultaneously probe 61 swings counterclockwise about its pivot 62** and disengages the tray apertures.

Motion of the tray from the position immediately beneath the hopper 41 to the deposit station 43 is effected by means of a fluid motor having an operating piston rod 69 driven by a cylinder 70 in known manner. Return movement causes finger **69*a* to engage rod 61*b* of crank 61*a* and to swing probe 61 to the upright solid line position to engage a succeeding tray since parts 61, 61*a* and 61*b*** are integral.

As is best shown in FIG. 12 a tray occupying the position designated at T2 in dotted lines is supported by horizontal level support rods 71 and 72. Movement of the tray from the position underneath the hopper through the position designated at T2 and into deposit station 43 is controlled by means of a frame structure generally designated at 73 in FIG. 12. Frame 73 includes a cross bar 74 which engages the trailing edge of the tray together with side walls 75 and 76. During the period when the tray rests completely on support rods 71 and 72, and within the confines of frame 73, the tray is under control. When the tray arrives at the position designated T3 however, special means are provided to insure that the leading edge E1 of the tray T3 is fully supported in cantilever like fashion while the trailing edge is still supported by the left hand ends of bars 71 and 72. Such structure includes release means generally designated at 77 and 78. Release means 77 is pivoted at 79 to the frame bar 75 and is biased by compression spring 80 for clockwise rotation about pivot 79. Guide 81 is outwardly tapered and engages the release element as shown in FIG. 12 and thus allows the release means 77 to swing in a clockwise direction due to the action of compression spring 80 and thus releases the leading edge E1 of tray T3 at the same instant that the trailing edge E2 clears the left hand ends of rods 71 and 72. By this means straight downward free fall of tray T3 is effected so that an accumulation of trays such as those indicated at T3–T8 in FIG. 4 is effected at deposit station 43.

For the purpose of moving the lowermost tray such as T8 at deposit station 43 into loading station 44, a cylinder 82 is provided and includes a piston rod 83 arranged to drive pusher bar 83*a* toward the left. This movement slides the lowermost tray T8 out of the loading station and underneath trays T3–T7 and into the receiving station and thus causes the tray to occupy the position designated at T9.

Subsequent manipulations of the tray and of the containers C are effected by parts driven by motor 84 which by means of endless driving elements 85 imparts rotary motion to gear box 86 and in turn to the driving elements 87 by means of endless driving element 88. Rotation of gear box 87 imparts operative motion to endless drive element 89 which drives sprocket 90 and endless element 91 and imparts rotary motion in a counterclockwise direction to sprocket 92. This motion causes the upper working reach of conveyor 93 to move from right to left. The right hand end of conveyor 93 is disposed about idler sprocket 94. Mounted on conveyor 93 are standards 96 between which containers such as C are disposed. A belt conveyor (not shown) brings the articles to conveyor 93. If desired conveyor 93 may be shortened so that its right hand end is disposed behind deposit station 43 in which event the infeed belt would be disposed adjacent that station. Containers C as shown in FIG. 5 are brought to the receiving station 6 by this means. Since receiving station 46 is immediately behind loading station 44 as best shown in FIGS. 4 and 5, it is simply necessary to elevate the containers such as C1, C2 and the other containers in a group and to transport those containers over to the loading station 44 where they are deposited in the tray T9.

Figure 7:
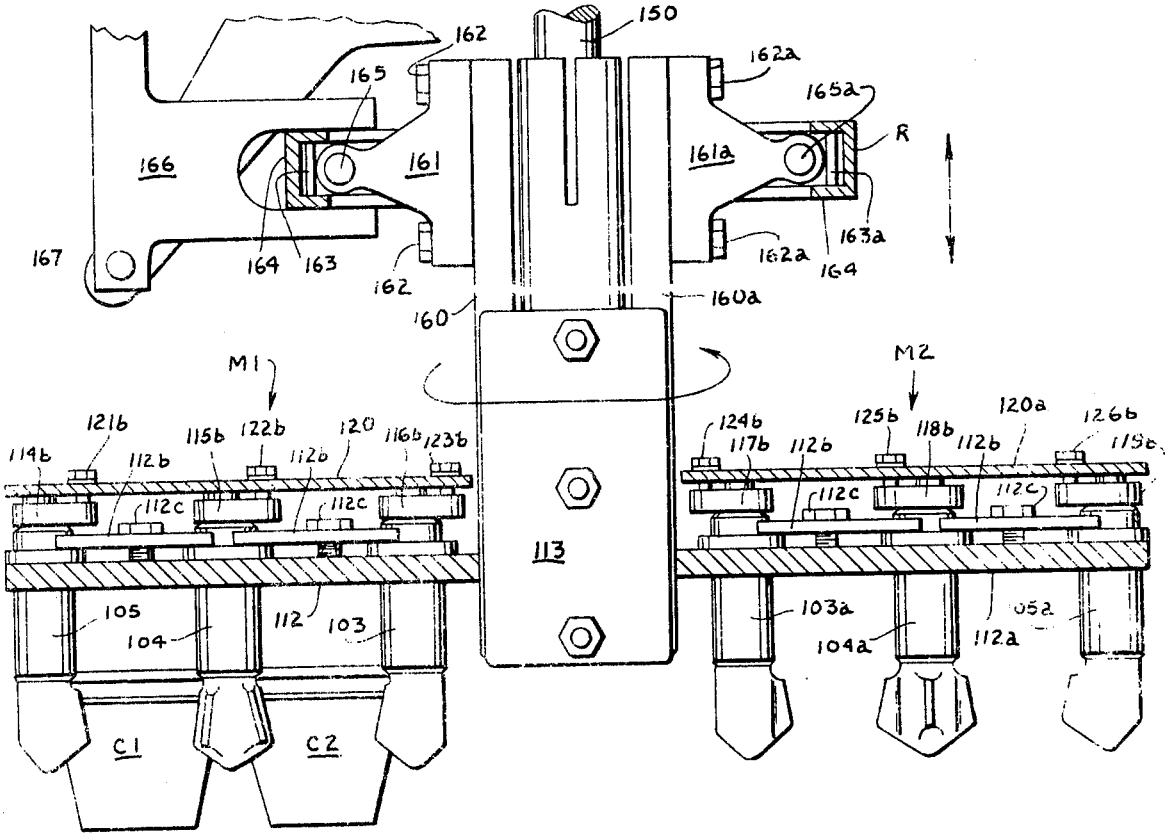
FIG. 7 is a view partially in section of the two article handling mechanisms shown in FIG. 5 and from the same vantage point except that in FIG. 7 the article handling mechanisms are shown in their uppermost positions.

The containers C are engaged and released by article engaging means as is best shown in FIGS. 3, 6, 7, 8 and 9 and which constitute components of article handling mechanisms M1 and M2. Fifteen article engaging elements designated by the numerals 97–111 respectively are rotatably mounted in a base plate 112 which is secured to a support element 113 and which forms journal mountings for the article engaging elements 97–111 of mechanism M1. These elements are anchored by cross-bars 112*b* and bolts 112*c*. As is apparent in FIGS. 6 and 7, each article engaging element is provided with a crank such as is indicated in FIG. 7 by the numerals 114*b*, 115*b* and 116*b*. Article engaging elements such as 103*a*, 104*a* and 105*a* are provided with cranks 117*b*, 118*b* and 119*b* and constitute components of article handling mechanism M2. Of course all the operating elements are provided with cranks but all the cranks are not shown in the drawings.

For the purpose of imparting angular motion through approximately 45° to all of the article engaging elements, a common operating member 120 and a similar common operating member 120*a* are provided. Common operating plate 120 is connected by means of bolts 121*b*, 122*b* and 123*b* with the cranks 114*b*, 115*b* and 116*b*. In like fashion the common operating member 120*a* is interconnected by bolts 124*b*, 125*b* and 126*b* with the cranks 117*b*, 118*b* and 119*b*.

From the description thus far it is apparent that bodily movement imparted to the plates such as the common operating members 120 and 120*a* causes simultaneous operation of all of the cranks and such rotation is accompanied by angular movement of all of the article engaging elements.

Figure 3:
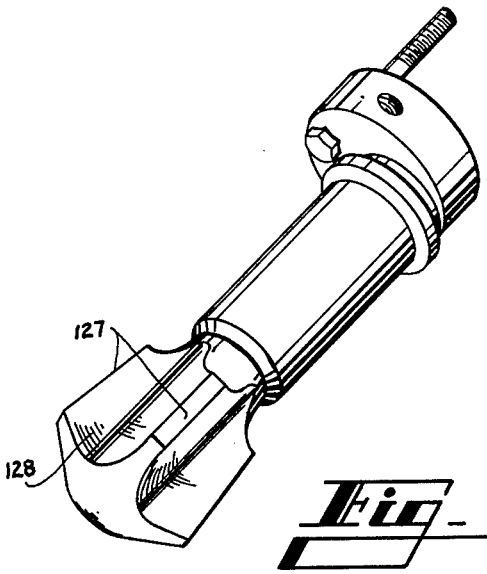
FIG. 3 is a perspective view of an article engaging element formed according to one aspect of the invention.
Figure 8:
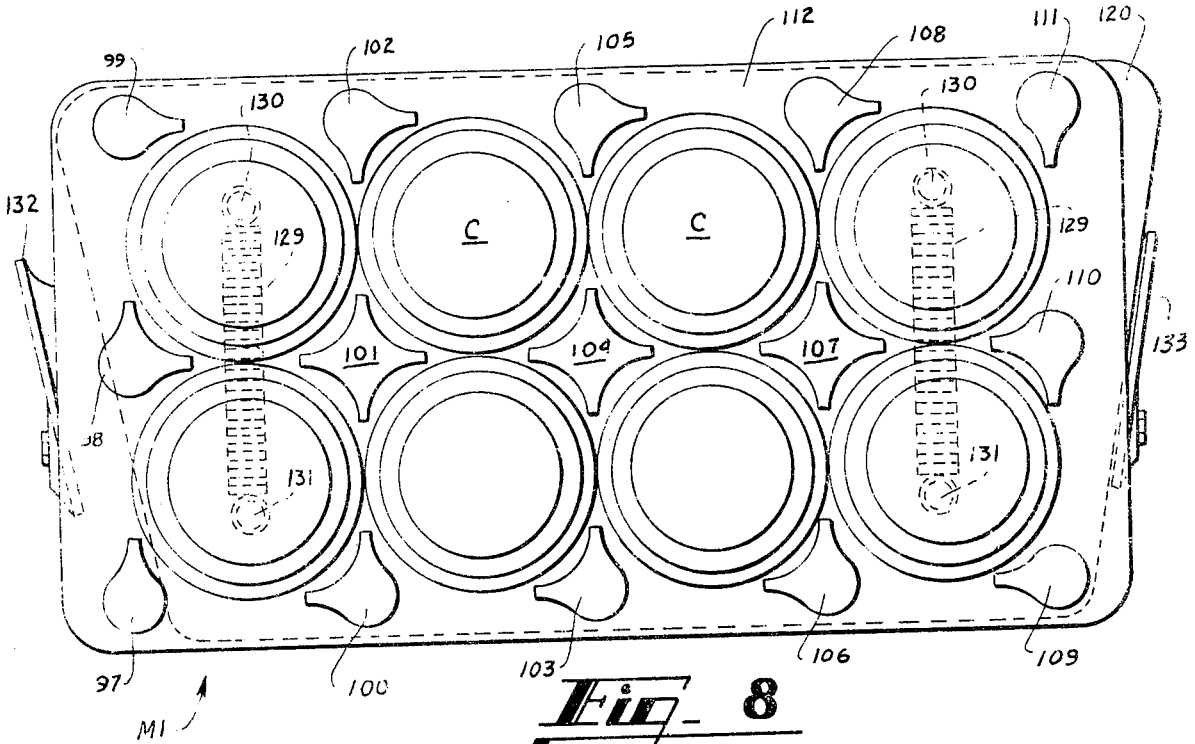
FIG. 8 is a plan view from below of an article handling mechanism such as is shown in FIG. 6 but with certain parts removed for clarity and which shows the article engaging elements disposed in their article releasing positions.

Since the containers C have tapered sides as is obvious from FIG. 2 and since each article engaging element is provided with at least one article engaging surface such as that indicated at 127 in FIG. 3 and an article clearing surface such as that indicated at 128 in FIG. 3, it is apparent that FIG. 8 depicts all of the article engaging elements of mechanism M1 with their article clearing surfaces adjacent one of the containers C to permit relative vertical movement between the article engaging elements and the containers C so that the containers C do not move with the article engaging elements. When the article engaging elements are moved by the common operating members such as 120 or 120*a* to the position shown in mechanism M2 of FIG. 9, the article engaging surface or surfaces such as 127 of each article engaging element are firmly in contact with the side wall of an adjacent container C. Thus vertical movement of the article engaging elements upward results in simultaneous lifting of all the containers C.

Figure 9:
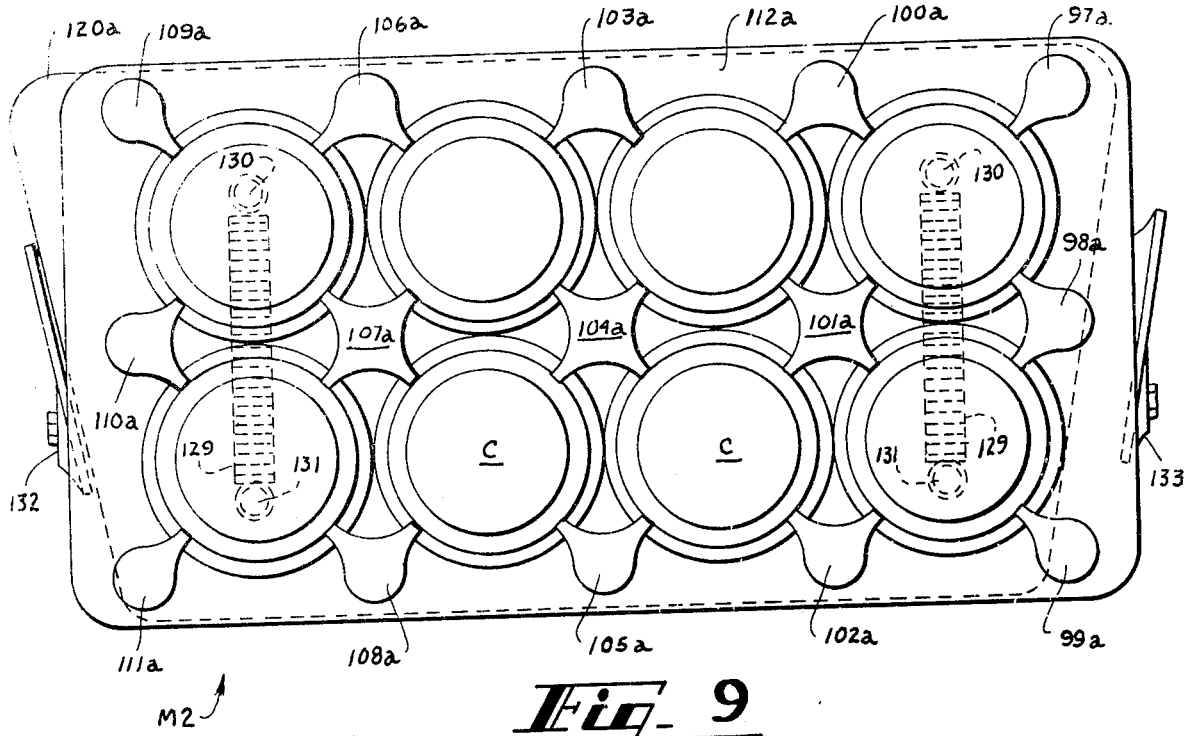
FIG. 9 is a view similar to FIG. 8 but with the article engaging elements shown in their article engaging or pick-up positions.

For the purpose of securing the common operating elements such as 120 and 120*a* in the position indicated in FIG. 8 or the position indicated in FIG. 9, tension springs such as are indicated at 129 are provided. These tension springs are anchored at one end to a pin 130 which is secured to a plate such as 112 or 112*a* while the other end of each spring 129 is secured to a pin 131 which is secured to common operating member such as 120 or 120*a*. The springs 129 are thus positioned so that they act as a toggle and hold the plate such as 120 or 120*a* either in the position shown in FIG. 8 or in the position represented in FIG. 9 against either the stop 132 on the one hand or 133 on the other.

The transport mechanism M1 such as that associated with the operating member 120 is adjusted with the article engaging elements occupying their release positions as indicated in FIG. 8 and such mechanism is lowered into a group of containers such as are indicated at C1 and C2 at the receiving station 44. Simultaneously an article handling mechanism M2 such as that associated with main operating member 120*a* is disposed at the loading station with containers C supported thereby and with the article engaging elements occupying the positions indicated in FIG. 9. Simultaneous movement of operating member 120 and 120*a* causes the article engaging elements at the receiving station to move from the positions indicated in FIG. 8 to the positions indicated in FIG. 9 and thus conditions the mechanism for lifting the articles off of the conveyor 93. Simultaneously movement of the article engaging elements at the tray loading station from the position represented in FIG. 9 to that represented in FIG. 8 causes the articles held by mechanism M2 associated with operating member 120*a* to be deposited into a tray such as T9.

In one embodiment of the invention each article handling mechanism such as M1 and M2 is arranged to handle eight containers as is represented in FIGS. 8 and 9. The trays however are arranged to handle 24 containers. Thus in accordance with one feature of the invention a tray located at T9 is first moved to the left as viewed in FIG. 5 to its ultimate left hand position represented in that figure. This movement is effected as shown in FIG. 4 by shift 140 driven from gear box 87 and on which is fixedly mounted a cam 141. Cam 141 is provided with a groove not shown in FIG. 4 and in which a cam follower 142 rides. Cam 142 is mounted on an arm 143. Arm 143 is fixed to oscillatable shaft 144 to the upper end of which an arm 145 is rigidly secured. Arm 145 is connected to pin 146 and in turn to support frame 147 in which tray T9 is disposed so that rotation of cam 141 imparts angular oscillatory movement to arm 145 and in appropriately timed relation intitially moves the tray such as T9 completely to the left as shown in FIG. 5. After eight articles are loaded on the right hand end of the tray, arm 145 begins a retracting action due to the action of cam 141 and associated parts and moves the frame 147 by two increments toward the right The first such incremental movement allows an additional eight articles to be deposited in the two middle rows and a final incremental movement of frame 147 causes the tray T9 to move to its outermost position to the right at which position a third group of eight articles is deposited in the two end rows of apertures. When the tray is completely loaded, it is simply pushed off to the left as viewed in FIG. 4 onto a suitable conveyor (not shown) by a subsequent unloaded tray such as that indicated at T8 and the process is repeated.

As is evident from FIG. 7 in order to cause the mechanisms M1 and M2 to change places, that is, to cause mechanism M1 to move from the receiving station 46 to the loading station 47, it is necessary that the shaft 150 as shown in FIG. 7 be rotated intermittently. FIG. 7 shows mechanisms M1 and M2 in their upper positions.

Figure 6:
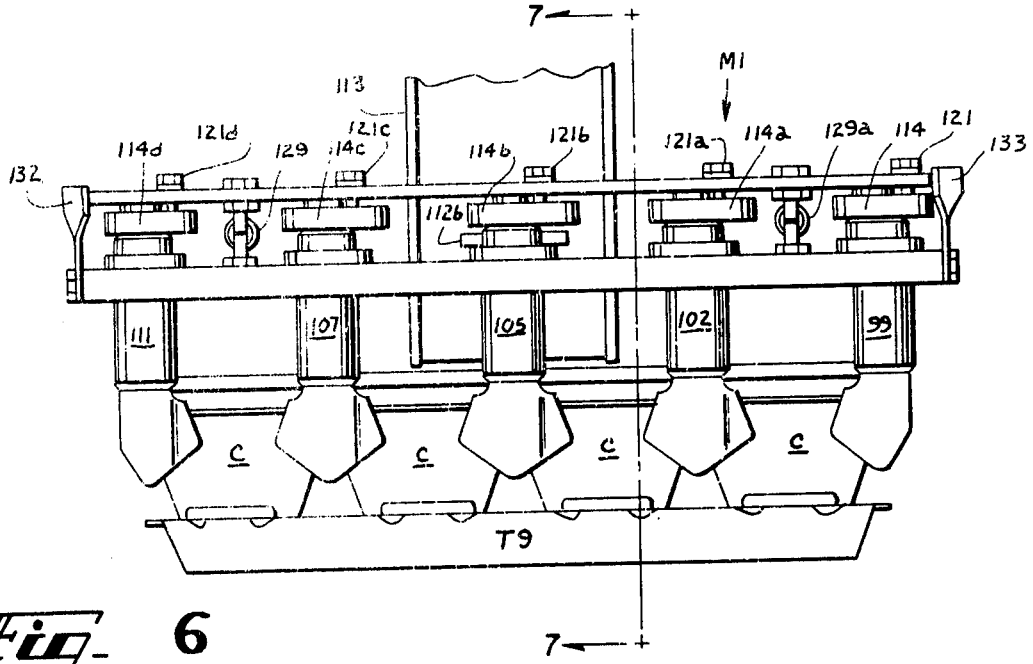
FIG. 6 is an enlarged view of one article handling mechanism such as is shown in FIG. 1.
Figure 10:
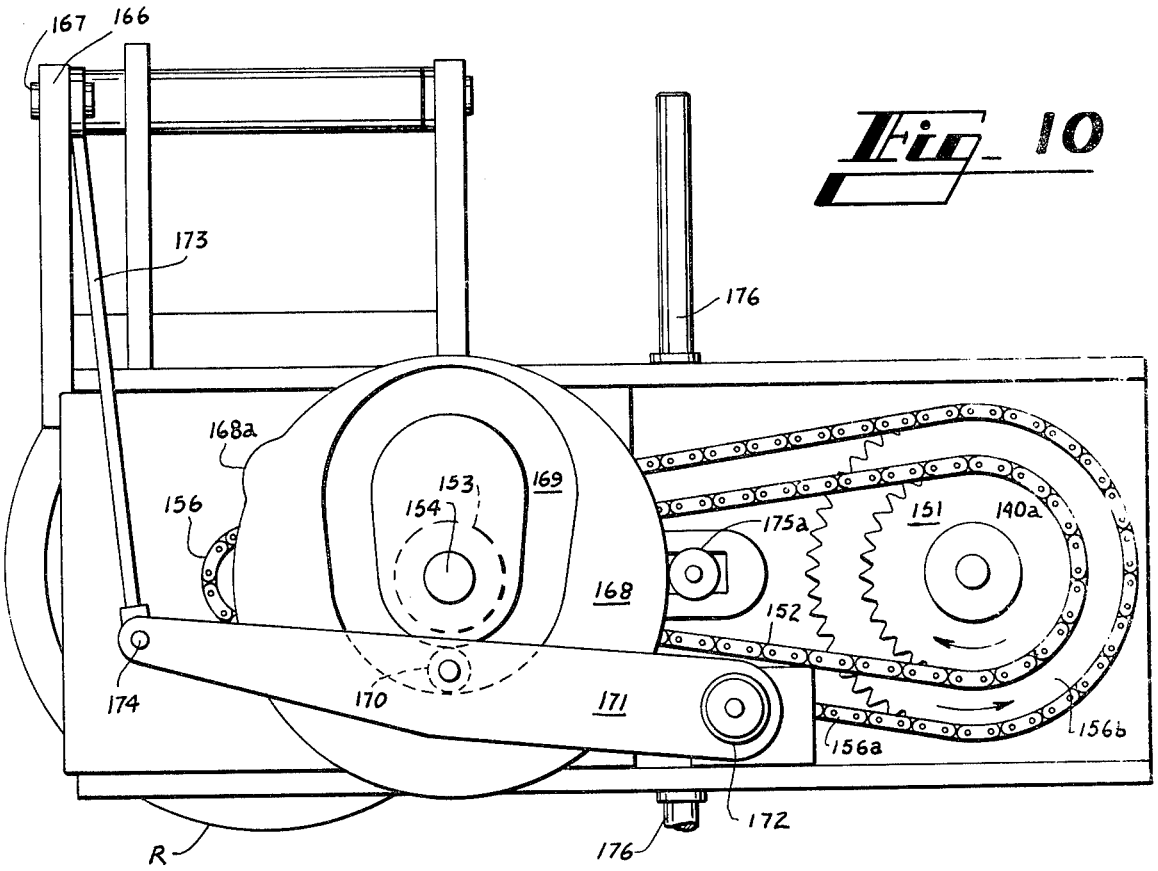
FIG. 10 is a top view of the mechanism shown in FIG. 5 but with certain parts removed for clarity.
Figure 11:
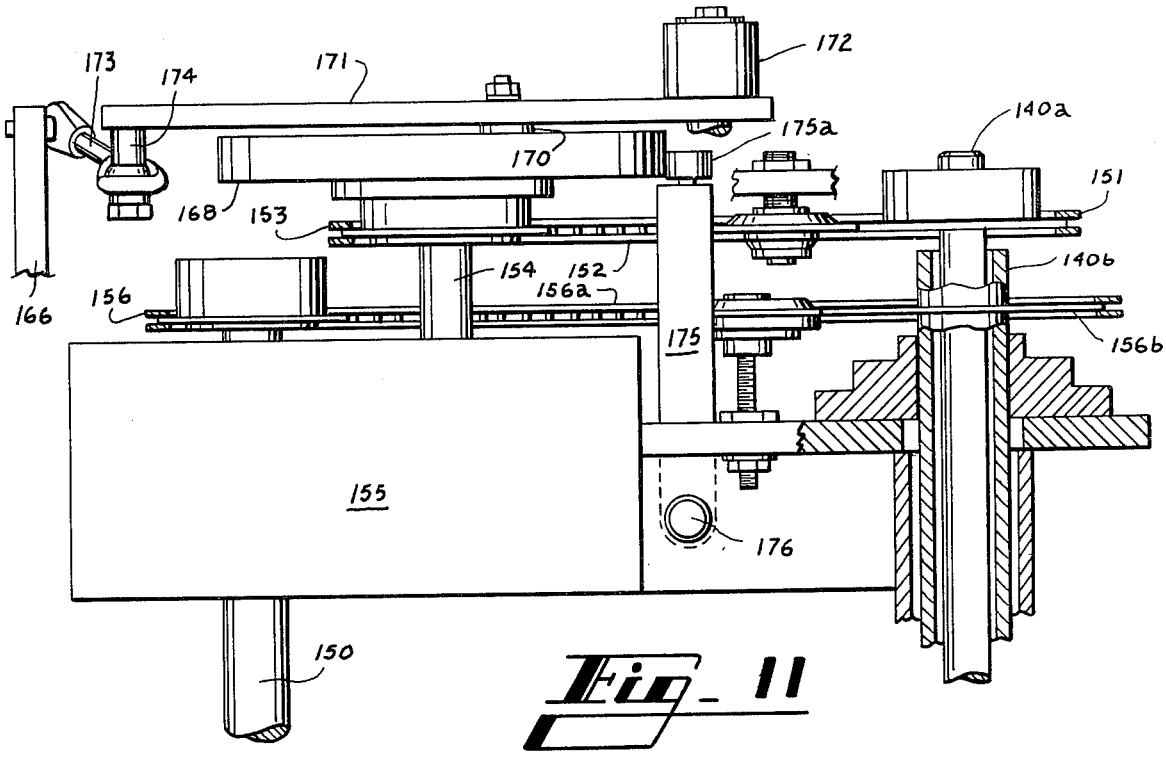
FIG. 11 is a front view of the mechanism shown in FIG. 10.

As is apparent in FIGS. 10 and 11 shaft 140 includes an inner shaft 140*a* and an outer concentric tubular shaft 140*b*. Driving effort from shaft 140*a* effects clockwise rotation of sprocket 151 as viewed in FIG. 10 and through chain 152 drives sprocket 153 and output shaft 154. Shaft 154 operates elements in driving device 155 which is conventional and which includes an output sprocket 156 which drives shaft 150 and which operates intermittently. In one application of the invention sprocket 156 drives chain 156*a* and sprocket 156*b* mounted on shaft 140*b* operates through 180° and then remains stationary for the succeeding 180° while the input shaft 154 operates continuously and at a constant speed. Thus shaft 150 as shown in FIGS. 5 and 6 operates through 180° to cause the mechanism M1 to move to the position occupied by mechanism M2 and likewise moves mechanism M2 to the position occupied by mechanism M1 during the 180° rotating period of shaft 150. During the dwell period of shaft 150 vertical movement is imparted to mechanisms M1 and M2.

Since shaft 140*b* operates intermittently from box 155, chain 89 and conveyor 93 and cam 141 operate intermittently and in synchronism with the other parts.

As is best shown in FIGS. 5 and 7, main support plate 112 of mechanism M1 is affixed to vertically slidable plate 160 to which a bracket 161 is bolted by bolts 162. Bracket 161 is provided with arcuate elements 163 which seat in the inner periphery of a ring structure R having side flanges 164. Arcuate elements 163 are secured by pins 165 to brackets 161. In like fashion mechanism M2 is arranged so that its support plate 112*a* is secured to vertically movable element 160*a* which is secured by bolts 162*a* to bracket 161*a*. Pin 165*a* secures arcuate element 163*a* within the channel like flanges 164 of the ring R.

In order to move the parts from the uppermost position where M1 and M2 are at the same level as indicated in FIG. 7 to their lowermost positions as indicated in FIG. 5, it is simply necessary to rotate operating arm 166 pivoted at fixed pivot 167 in a clockwise direction about pivot 167 to the position shown in FIG. 5. This action lowers the bracket 161 somewhat and lowers the bracket 161*a* a greater amount due to the difference in distance of these brackets from the pivot 167. This lowering and subsequent reverse elevation of the transport means comprising ring R and brackets 161 and 161*a* and parts associated therewith is effected during the dwell time or non-rotating period of the shaft 150.

For the purpose of imparting rocking movement to operating arm 166, the mechanism shown in FIGS. 10 and 11 is employed. Rotation of shaft 140*a* through chain 152 imparts rotary motion to sprocket 153. This motion rotates cam 168 in which a cam groove 169 is formed. Cam follower 170 rides in groove 169 and is mounted on lever 171 pivoted to fixed pivot 172. Thus rotation of cam 168 imparts oscillatory movement to arm 171. This movement imparts bodily movement to rod 173 pivoted at 174 to arm 171 and in turn effects a rocking action of operating arm 166 about its pivot 167. This rocking motion is apparent in FIG. 5 where the arm 166 is shown in its extreme position wherein the mechanisms M1 and M2 occupy their lowermost positions. As the cam 168 rotates, cam follower 170 is caused to swing farther away from the center of rotation of shaft 154 and thus causes elevation of mechanisms M1 and M2 due to the tension force imparted to link 173 which in turn rocks the operating arm 166 in a counterclockwise direction about pivot 167 to cause the parts to assume the topmost positions represented in FIG. 7.

For the purpose of imparting operating movement to the operating plates 120 and 120*a*, a cam surface 168*a* is affixed to the outer periphery of cam 168. This cam at the proper time engages a cam follower 175*a* which causes a pair of vertically disposed operator rods 175 only one of which is observable in FIG. 4 to swing about pivot 176 so as to cause rods 175 to engage simultaneously the operating plates 120 and 120*a* of both the mechanisms M1 and M2. This simultaneous operation causes one mechanism such as M1 to move for example from the condition represented by FIG. 8 to that represented by FIG. 9 at the receiving station so as to cause mechanism M1 to pick up containers. Simultaneously the mechanism such as M2 is moved from the condition represented in FIG. 9 to that represented in FIG. 8 at the loading station and thus causes the mechanism M2 to deposit containers in the ray T9. Once the cam surface 168*a* moves past the cam follower 175*a* the two vertical elements 175 pivoted at 176 return to vertical positions and the parts of the article engaging elements remain in the positions described due to the over center toggle action of the springs 129.

The embodiments of the invention in which an exclusive property or privilege is claimed are defined as follows:

1. In a loading system for removing a group of articles from a receiving station and for depositing the group of articles at a loading station and including support structure rotatable about a vertical axis and disposed between said stations, a pair of substantially identical article handling mechanisms mounted on said support structure and arranged to swing thereabout, said mechanisms being arranged for simultaneous disposition at said stations respectively and wherein the improvement comprises a pair of vertically reciprocable support brackets mounted in diametrically opposed relation on said support structure and interconnected with said article handling mechanisms respectively, a support ring disposed about said brackets and slidably connected therewith so as to accommodate rotation of said brackets and mechanisms about said vertical axis, and means for tilting said support ring into and out of a horizontal plane to vertically reciprocate said support brackets and said article handling mechanisms connected thereto.

2. A loading system according to claim 1 wherein said support structure includes a vertically disposed rotatable shaft interconnected with a common driving mechanism for imparting rotary movement to said support structure.

3. A loading system according to claim 2 wherein said driving mechanism is arranged to drive said shaft intermittently and to afford dwell intervals interspersed between periods of rotation.

4. A loading system according to claim 3 wherein said support ring is tilted only during dwell intervals of said shaft.

5. A loading mechanism according to claim 4 wherein operating means is interconnected with both of said mechanisms for causing engagement and disengagement of: groups of articles at said receiving station and at said loading station respectively.

6. A loading system according to claim 5 wherein said operating means is arranged to effect engagement and disengagement of the articles only during dwell intervals of said shaft.

7. A loading system according to claim 5 wherein cam means is arranged to impart simultaneous movement to a pair of arms to cause those arms to engage a part of each of said mechanisms to cause said mechanisms respectively to engage and disengage the groups of articles at said receiving station and at said loading station.

8. A loading system according to claim 1 wherein a tray is moved into said loading station by motive means operable in synchronism with said transport means.

9. A loading system according to claim 8 wherein said motive means is arranged to move said tray incrementally while in said loading station so as to accommodate a plurality of loading operations of at least one of said article handling mechanisms while a single tray is disposed at said loading station.

10. A loading system according to claim 1 wherein synchronously operable conveyor means is arranged to supply a group of articles to said receiving station.

11. A loading system according to claim 1 wherein said receiving and said loading stations are disposed at different levels and wherein said article handling mechanisms are relatively movable vertically.

12. A loading system according to claim 1 wherein said support structure is rotatable to move said article handling mechanism between said loading and said receiving stations in sequence.

13. A loading system according to claim 1 wherein a pivotally mounted operating member is mechanically connected with said ring for imparting tilting movement thereto thereby to impart simultaneous vertical movement to said article handling mechanisms.

14. A loading system according to claim 1 wherein each of said mechanisms comprises a plurality of horizontally spaced articles engaging elements disposed about the article, each of said elements being angularly movable about a substantially vertical axis, and each element having an article engaging surface and an article clearing surface disposed about its periphery.

* * * * *